US010472104B2

(12) United States Patent
Jenkins et al.

(10) Patent No.: US 10,472,104 B2
(45) Date of Patent: Nov. 12, 2019

(54) METHOD OF FABRICATING COFFEE PODS AT POINT OF SALE

(71) Applicants: Kurt Allen Jenkins, Sammamish, WA (US); Edward Francis Burress, West Linn, OR (US); Darryl Ingvard Jensen, Petaluma, CA (US); James Bernard Jensen, Sheridan, WY (US); Eugene J. Wallace, Wilsonville, OR (US)

(72) Inventors: Kurt Allen Jenkins, Sammamish, WA (US); Edward Francis Burress, West Linn, OR (US); Darryl Ingvard Jensen, Petaluma, CA (US); James Bernard Jensen, Sheridan, WY (US); Eugene J. Wallace, Wilsonville, OR (US)

( * ) Notice: Subject to any disclaimer, the term of this patent is extended or adjusted under 35 U.S.C. 154(b) by 745 days.

(21) Appl. No.: 15/078,505

(22) Filed: Mar. 23, 2016

(65) Prior Publication Data

US 2017/0210498 A1 Jul. 27, 2017

Related U.S. Application Data

(63) Continuation-in-part of application No. 15/005,528, filed on Jan. 25, 2016, now abandoned.

(51) Int. Cl.

| | |
|---|---|
| ***B65B 29/02*** | (2006.01) |
| ***B65B 1/02*** | (2006.01) |
| ***B65B 1/04*** | (2006.01) |
| ***B65B 57/20*** | (2006.01) |
| ***B65B 63/00*** | (2006.01) |

(Continued)

(52) U.S. Cl.
CPC ..... *B65B 29/02* (2013.01); *B65B 1/02* (2013.01); *B65B 1/04* (2013.01); *B65B 7/2864* (2013.01);

(Continued)

(58) Field of Classification Search
CPC ..... B65B 1/02; B65B 57/20; B65B 7/2864; B65B 43/50; B65B 65/00; B65B 7/2842; B65D 1/30; B65D 85/8046

(Continued)

(56) References Cited

U.S. PATENT DOCUMENTS 3,021,001 A * 2/1962 Donofrio ..... B65D 1/30 206/820
3,775,932 A * 12/1973 Jeney ..... B29C 65/18 53/433

(Continued)

FOREIGN PATENT DOCUMENTS

WO WO 2011/039711 * 4/2011 ..... B65B 9/06

*Primary Examiner* — Andrew M Tecco
*Assistant Examiner* — Nicholas E Igbokwe
(74) *Attorney, Agent, or Firm* — Mark S Hubert

(57) ABSTRACT

A method of fabricating coffee pods at a point of sale location using a coffee pod dispensing device with shell less, expandable coffee pods. The fabrication is initiated by tactile input from a control panel that determines the parameters of the coffee pods to be fabricated and generates the operational signals for the dispensing device. Fabrication there after progresses sequentially through a series of operations that involves the loading of the coffee pods onto a pod advancing means which then takes the coffee pods through the steps of expansion, filling, sealing and delivery. To accomplish this the pods are compressible pods arranged in a linear array that allows for pleated or stacked storage in a pod loading means within the device's enclosure, as well as continuous feed capabilities.

8 Claims, 16 Drawing Sheets

(51) Int. Cl.
*B65B 65/00* (2006.01)
*B65B 7/28* (2006.01)
*B65D 85/804* (2006.01)

(52) U.S. Cl.
CPC ..... *B65B 57/20* (2013.01); *B65B 63/00* (2013.01); *B65B 65/00* (2013.01); *B65D 85/8046* (2013.01)

(58) Field of Classification Search
USPC ..... 220/23.2, 23.4
See application file for complete search history.

(56) References Cited

U.S. PATENT DOCUMENTS 4,069,349 A * 1/1978 Shaw ..... B65B 9/20 426/395
4,166,412 A * 9/1979 Versteege ..... A61J 1/10 156/514
4,200,481 A * 4/1980 Faller ..... B29C 51/165 156/285
2003/0136088 A1* 7/2003 Wilhelm ..... B65B 7/164 53/467
2004/0164076 A1* 8/2004 Baker ..... B65D 1/30 220/23.4
2008/0197148 A1* 8/2008 Illy ..... A47J 47/01 222/152
2008/0299262 A1* 12/2008 Reati ..... B65B 29/022 426/84
2010/0077708 A1* 4/2010 Kobayashi ..... B65B 5/103 53/501
2010/0140279 A1* 6/2010 Tyson ..... B65D 11/02 220/666
2015/0225099 A1* 8/2015 Villain ..... B65B 29/02 426/115

* cited by examiner

METHOD OF FABRICATING COFFEE PODS AT POINT OF SALE

PRIORITY

The following application is a continuation in part of U.S. patent application Ser. No. 15/005,528 entitled "Coffee Pod for Point of Sale Device" filed Jan. 25, 2016, and incorporates by reference all the material therein.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a method of fabrication coffee pods from a device to be located at a point of sale location. The device is capable of the individualized, personalized packaging of generally elutable or dissolvable materials such as coffee, tea, herbs, organics and the like. This disclosure incorporates by reference the entire disclosure of U.S. Utility patent application Ser. No. 15/005,528, filed Jan. 25, 2016.

BACKGROUND

The American populace loves their coffee. Most people begin their day with a cup of their favorite blend while others continue to partake throughout the day, commonly obtaining it from a their favorite "mom and pop" coffee roaster or a commercial vendor such as Starbucks®. However, of lately, many brew their own coffee using an individual brewing device such as a Keurig® brand coffee brewer. These allow for individual sized brewings using what have been come to be known as "k cups" or "coffee pods".

Along with a populace that loves their coffee, come a segment of coffee aficionados. This breed of coffee drinker seeks specific coffee beans or coffee bean blends. The commercial coffee vendor market has rallied to meet this segment's demand, with most stores offering a plethora of coffee beans, however the selection of available coffee pods lags far behind. This is understandable, as to stock numerous blends of quantity boxed coffee pods takes up valuable store space. Thus, the coffee aficionado that relies on their individual brewing device has a rather limited selection.

This situation worsens when the coffee aficionado is at a location away from his individual brewing device or only has bulk brewing capabilities. Such an example would be rough woods camping. With the cost of these specialty beans as high as they are, no one wants to waste good coffee on the unappreciative or those with an undiscerning palate.

Another problem lies not with the coffee aficionado but rather with the small "mom and pop" coffee roasters. These entrepreneurs generally lack the equipment to pre package their coffees into pod format for their clients, and as such, loose this share of the market.

To date the commercially available coffee pods are made at a location remote from their point of sales and as such reflect a time lag between grinding and use. Further, these pods are prepared in common varieties by the larger coffee roasters. Often an aficionado of coffee has developed a taste for some of the more rare beans or even for a specific blend of beans. Neither of these are available in pod form. Complicating the issue, to make the pods affordable (since the price of commercially preparing these dramatically rises the cost of the coffee) they are packaged in large boxes, often in the 90 pod range. This, for many, takes months to go through and freshness becomes a taste issue.

Henceforth, a method of preparing small quantities of coffee pods that are blended to the consumer's taste from the bean or beans of their own selection, directly at the store or coffee roasters, would fulfill a long felt need in the coffee industry. This new method utilizes new technologies with newly developed devices in a unique and novel configuration.

BRIEF SUMMARY

In accordance with various embodiments, a method for fabricating small batches of personally selected or personally blended, freshly ground coffee in coffee pod format provided.

In one aspect, a method is provided that allows a consumer to fabricate small batches of coffee pods with their own elutable or dissolvable materials such as coffee, tea, herbs, organics, and flavorings (e.g. vanilla bean) and the like.

In yet another aspect, a method that allows the for the fabrication of coffee pods from a high speed, high volume, point of sale mechanized coffee pod distributing device that is capable of grinding, filing, sealing and packaging elutable or dissolvable materials is provided.

Various modifications and additions can be made to the steps of the method discussed without departing from the scope of the invention. For example, while the steps of the methods described above refer to a specific order, the scope of this method also includes different combinations of sequences of steps that fabricate the same coffee pod.

BRIEF DESCRIPTION OF THE DRAWINGS

A further understanding of the nature and advantages of particular methodology embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

DETAILED DESCRIPTION OF CERTAIN EMBODIMENTS

Figure 1:
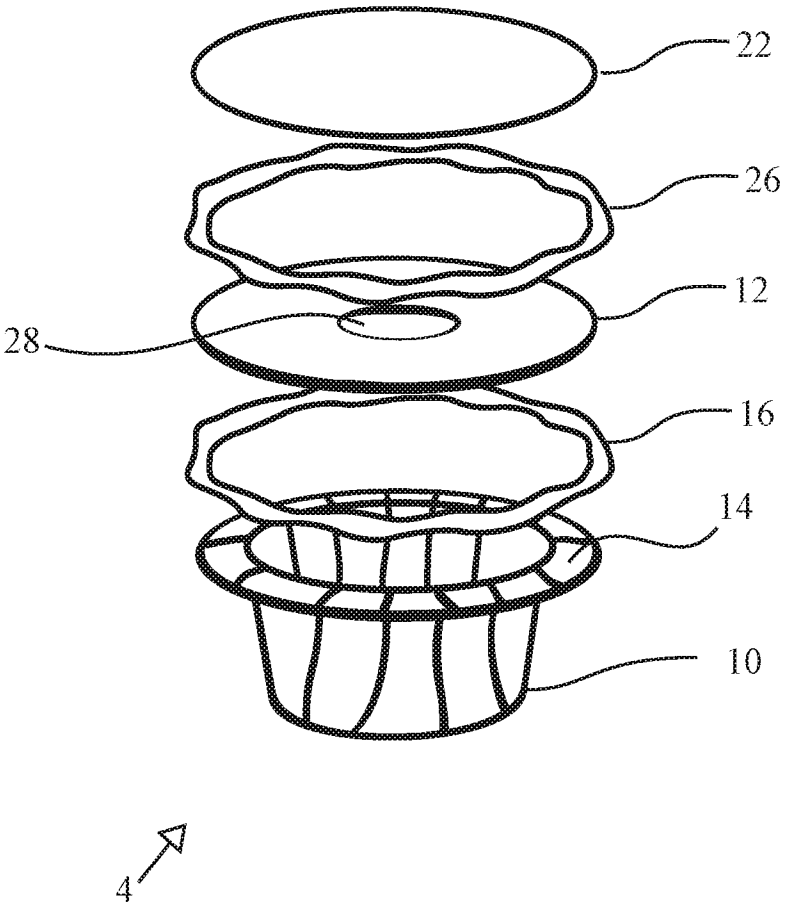
FIG. 1 is a front perspective view of the first embodiment coffee pod.

While various aspects and features of certain embodiments have been summarized above, the following detailed description illustrates a few exemplary methodology embodiments in further detail to enable one skilled in the art to practice such methods. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various steps are ascribed to different embodiments, it should be appreciated that the steps described with respect to one embodiment may be incorporated with other embodiments as well. By the same token, however, no single step or steps of any described embodiment should be considered essential to every embodiment of the invention, as other embodiments of the invention may omit such steps.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

As used herein, the term "adjacent" is to mean neighboring, next to, by the side of, bordering on, or beside.

As used herein, the terms "coffee pod" or "pod" refers to the individualized disposable coffee bean fillable containers that may be used in any or all of the commercially available single serve coffee brewing machines. An example of such a machine is the Keurig™ brand of coffee machines. It is known that tea, herbs, coco, powdered milk, and other dissolvable or elutable materials may be substituted for the coffee beans intended for packaging in the containers of the present invention. Any reference to coffee or coffee bean herein shall be understood to incorporate the aforementioned eluatable materials.

As used herein the terms "inflatable" and "inflatably expanedable" refer to the characteristic of a body in a spatially compressed configuration that may be expanded to its full spatial configuration with the application of air, application of a vacuum or application of a mechanical pusher there into. The body need not be airtight to allow this expansion.

As used herein, the term "means to separate" refers to a mechanical device disposed between adjacent coffee pods that allows for the separation of the pods by such means as tearing, increasing in physical spacing between pods, twisting or stretching and cutting. Perforations incorporated onto the tab joining adjacent coffee pods would be one example thereof.

As used herein, the term "compressible" refers to the ability for an article to be reduced to a spatially compressed configuration that represents a fraction of the space that it occupies in its expanded or operational state.

As used herein, the terms "micro processor" and "processor" mean a single processor or processor core (of any type) or a plurality of processors or processor cores (again, of any type) operating individually or in concert. These are a computer processor that incorporates the functions of a computer's central processing unit (CPU) on a single integrated circuit (IC), or at most a few integrated circuits. They are a multipurpose, programmable device that accepts digital data as input, processes it according to instructions stored in its memory, and provides results such as starting and stopping mechanized equipment, outputting signals to a visual display and conducting internet payment transactions, to name a few, as output. The functionality described herein can be allocated among the various processors or processor cores as needed for specific implementations. Thus, it should be noted that, while various examples of processors may be described herein for illustrative purposes, these examples should not be considered limiting.

The terms "means for separation", "pod advancing means", "means for pod expanding", "coffee filling means" and "sealing means" as used herein including the claims, is to be interpreted according to 35 USC 112, [para] 6.

The present invention relates to a novel design for the manufacture of a coffee pod using a device that can provide some or all of the various functions of grinding, filling, sealing and packaging elutable or dissolvable materials into a "k cup" of coffee pod format for the individual consumer. Simply stated, it is a method of manufacturing a coffee pod using a high speed, high volume point of sale, mechanized coffee distributing device intended for location at the point of sale such as the coffee shop, grocery store, etc.

While certain features and aspects have been described with respect to exemplary embodiments, one skilled in the art will recognize that numerous modifications are possible. For example, while various methods and processes described herein may be described with respect to particular structural and/or functional components for ease of description, methods provided by various embodiments are not limited to any particular structural and/or functional architecture. Similarly, while certain functionality is ascribed to certain system components, unless the context dictates otherwise, this functionality can be distributed among various other system components in accordance with the several embodiments.

The operation and steps in the method of producing coffee pods from the coffee pod point of sale fabrication device 2 (FIG. 7) is best understood after a brief explanation of the novel coffee pod 4 (FIG. 1) that is to be used by the fabrication device 2.

The coffee pod fabrication device 2 utilizes empty coffee pods from a linked, continuous-feed capable ribbon format 6 (FIG. 3) (single linear array) or tape format 8 (FIG. 4) (multiple linked linear arrays.) Each coffee pod 4 is capable of various structural embodiments with the commonality of a lower expandable well section 10 affixed to an upper rigid upper support structure (lid) 12. (FIG. 1) The well section 10 is a concave formed filter element, generally having filaments designed for allowing coffee particles to pass through which are less than approximately 10 to 15 micrometres in diameter. Generally, the well section 10 will have an upper flange 14 that has its top face adhesively affixed to the bottom face of the upper lid 12. The well 10 will generally be constructed of material flexible enough to avoid any bottom piercing actions of certain single serve coffee brewing equipment. As shown in FIG. 5, each pod is compressible in that its well 10 may be flattened to lie adjacent and parallel to the lid 12 so as to minimize the space occupied by the unexpanded pod, and maximize the amount of pods 4 that can be stored in the device's housing.

Figure 3:
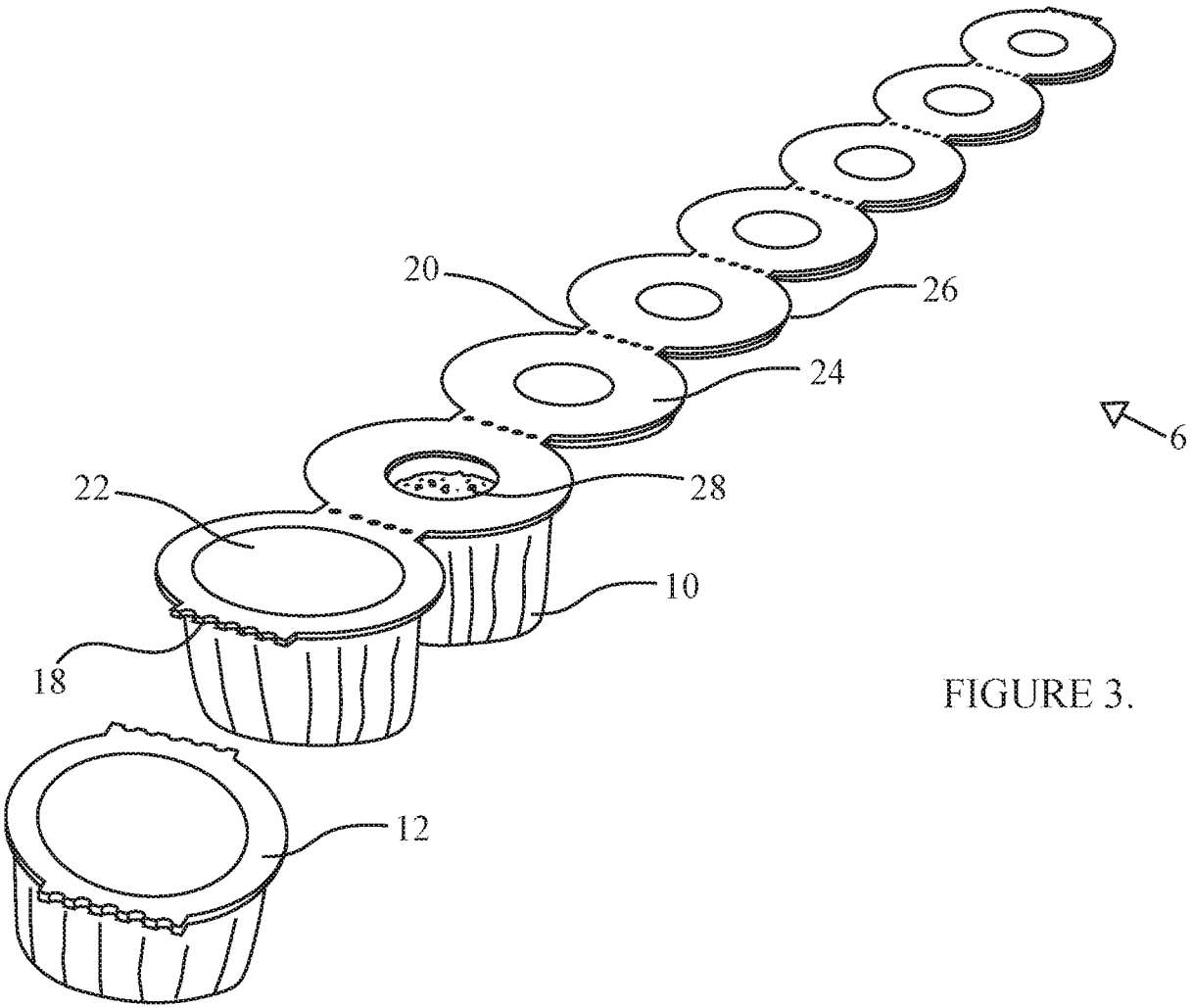
FIG. 3 is a perspective view of a single linear array of coffee pods showing its structural evolution throughout the coffee filling process.
Figure 4:
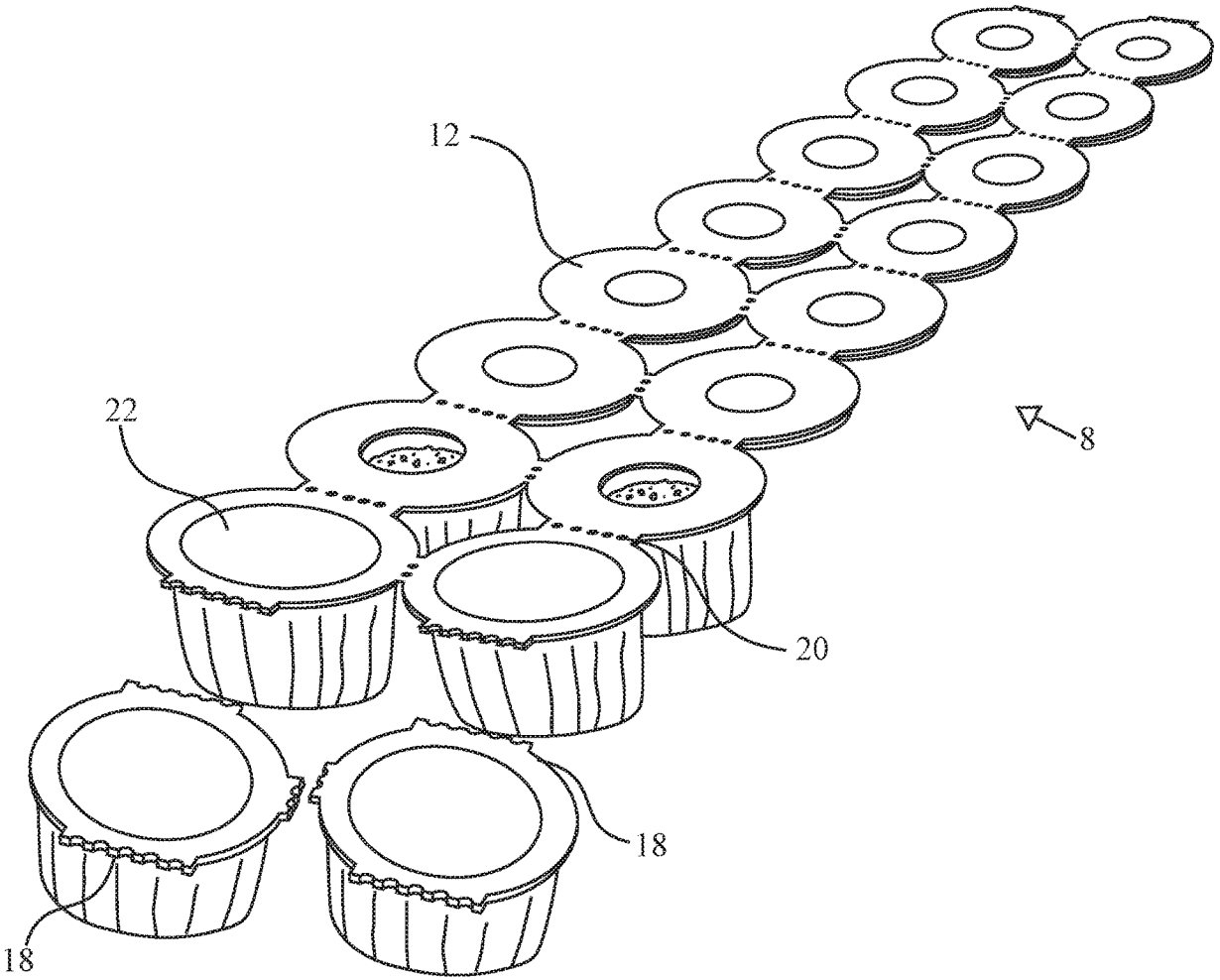
FIG. 4 is a perspective view of a double linear array of coffee pods showing its structural evolution throughout the coffee filling process.
Figure 5:
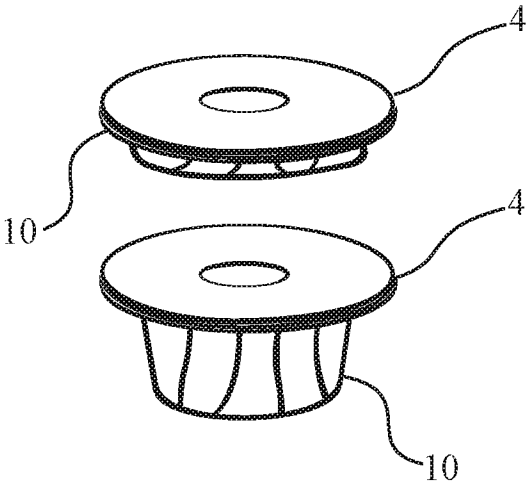
FIG. 5 is a comparative view of a expanded coffee pod and a compressed coffee pod.

In the preferred embodiment of FIGS. 1, 3 and 4, the support structure is only the upper lid 12 and well adhesive 16. The well 10 may be stretched or pleat folded with or without the use of a concave mold to form its concave configuration. The upper lid 12 is generally circular and has a pair of connection tabs 18 extending therefrom its exterior periphery. The upper lid 12 is made in a connected linear series with the upper lids of the adjacent coffee pods 4. The connection tabs 18 are disposed 180 radial degrees apart on the upper lid 12. The means for separating 20 is seen as a linear series of perforations extending axially across the tabs 18 at the midpoint between adjacent upper lids 12. The cap 22 is separate from the rest of the coffee pod 4 and is adhesively affixed to the periphery 24 of the upper face of the upper lid 12 by a second adhesive 26. This second adhesive 26 may reside on the underside of the cap 22.

It is to be noted that the upper lid 12 has an orifice 28 therein to accommodate both the means for pod expanding (air inflater) 52 and the means for coffee filling 80 so as to allow the expansion of the well 10 of the pod 4 and the insertion of ground coffee beans. The upper lid 12 will generally be made of a natural paper or cellulose fiber. The upper lid 12 will act as a stiffener and be of thick enough material and will have enough material existing about its planar surface to ensure that the coffee pod 4 does not collapse when it cap 22 is being pierced by a single serving coffee brewing machine.

Figure 2:
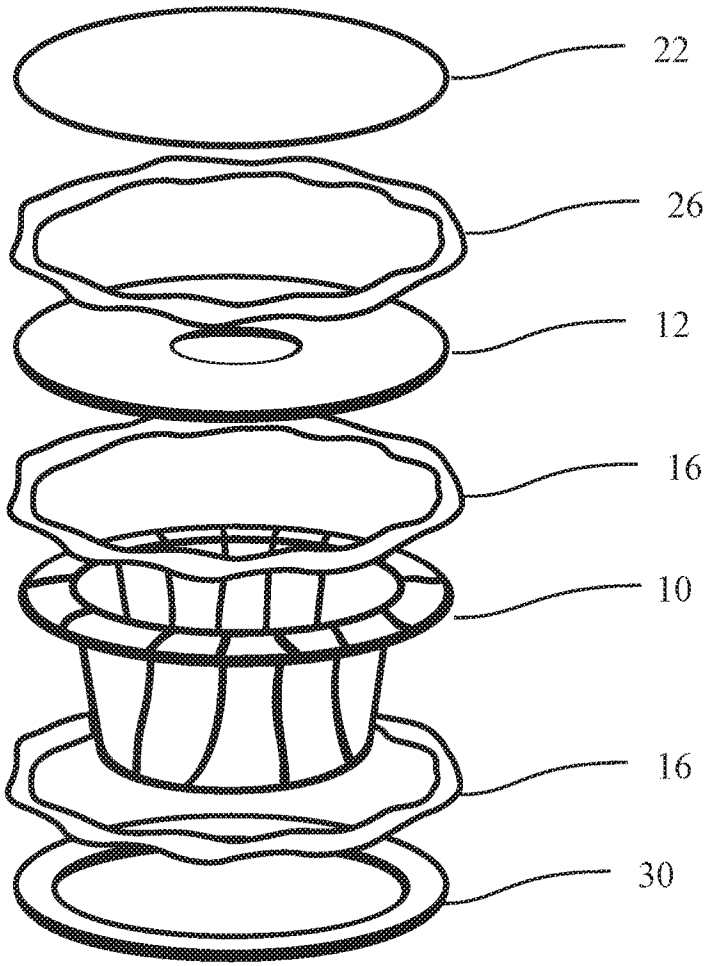
FIG. 2 is a front perspective view of the second embodiment coffee pod.

The second embodiment coffee pod of FIG. 2 retains the same structural elements as the first embodiment but to the support structure is added an additional stiffener ring 30 that has its upper face adhesively affixed by adhesive 16 to the bottom face of the well section 10. The stiffener ring 30 is also preferably from the same natural paper or cellulose fiber the upper lid 12 is made from. The stiffener ring ads stability and strength to the coffee pod as well as ensuring that the filter material that forms the well section 10 is suitably affixed in place under the upper lid 12.

Figure 14:
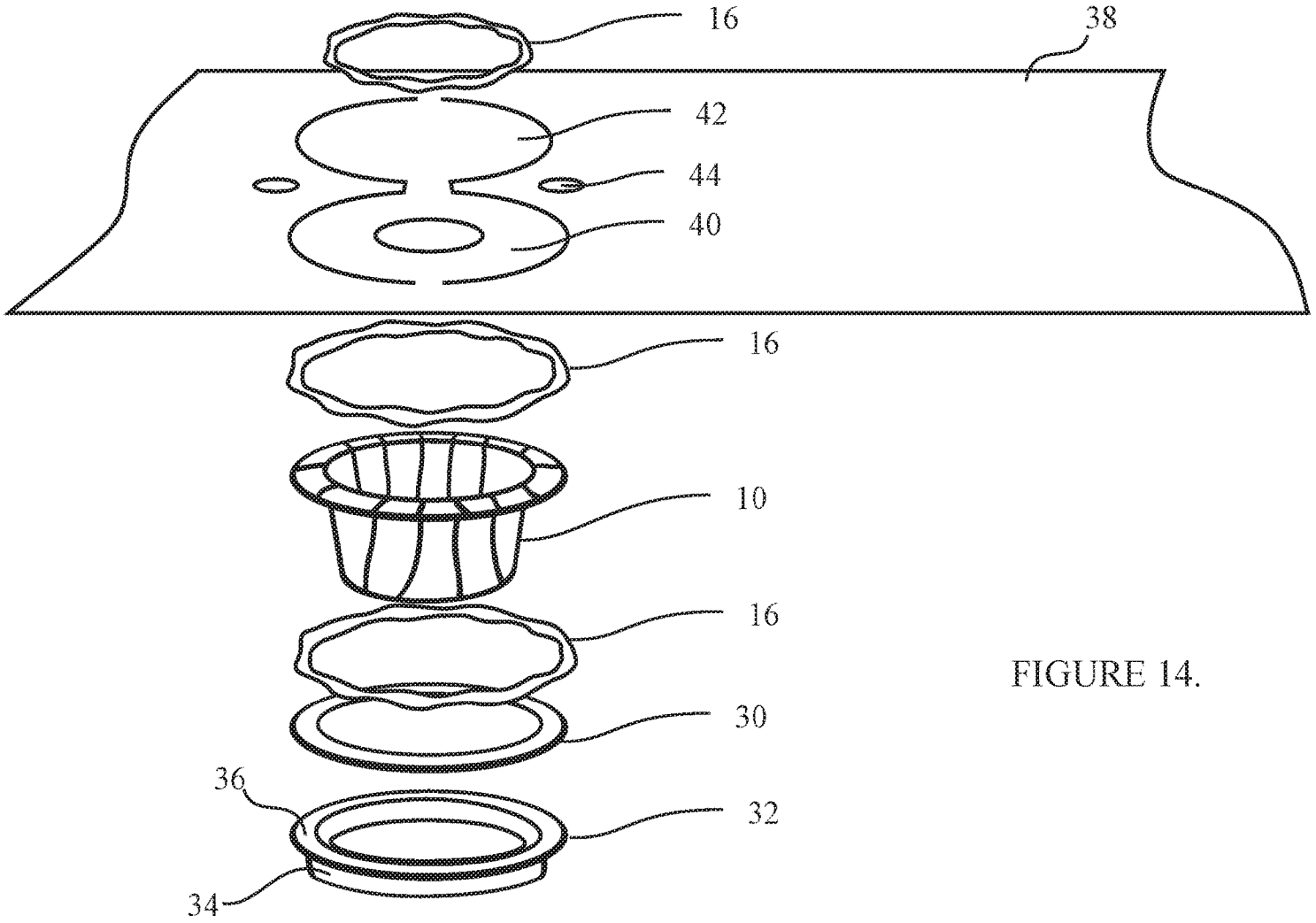
FIG. 14 is a front perspective view of a third embodiment coffee pod and seal on a tape feed substrate.

FIG. 14 shows a third embodiment coffee pod that has an additional deep stiffener ring 32 that may be used with or without the stiffener ring 30. The deep stiffener ring 32 is not planar but rather has a short cylindrical extension 34 that extends perpendicularly from the flange section 36. This adds rigidity to the entire support structure thus allowing for the use of thinner elements. The deep stiffener ring 32 may be made from 100% biodegradable material or where extreme strength is needed, it may be fabricated from a polymer. The embodiment with the deep stiffener ring has drawbacks in that these pods do not stack as well as those pods without it. It is to be noted that in this third embodiment, the pod uses a foldable upper lid and seal assembly with the adhesive 16 disposed between the first foldable half 40 and the second foldable half 42. In this embodiment the pod's upper lid and seal is carried on a tape substrate 38 from which it can be mechanically folded and separated. The tape substrate 38 has at location orifices 44 so as to allow the tap substrate to be precisely located during the pod fabrication stage. This may be utilized in conjunction with a toothed cog as is well known by one skilled in the art.

Figure 6:
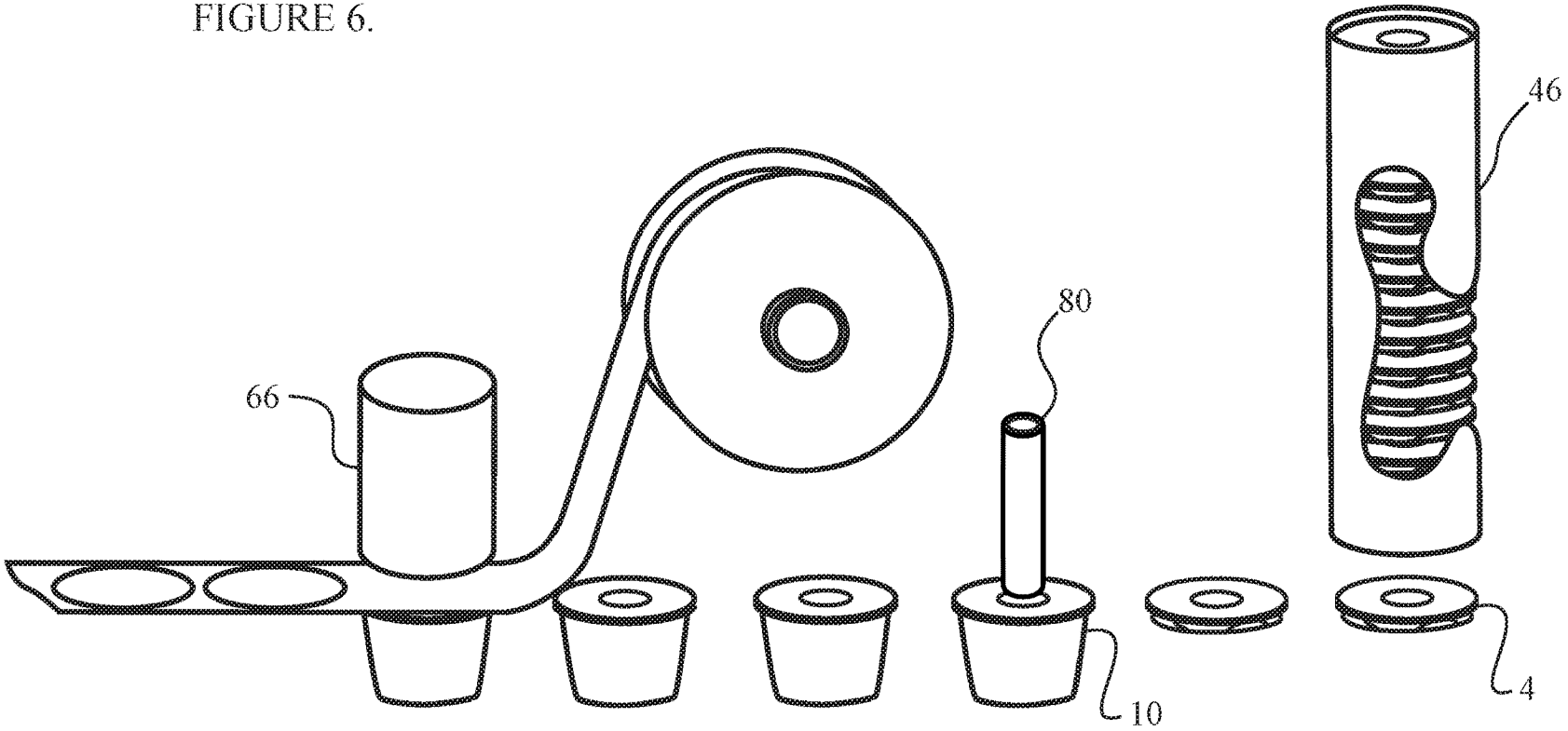
FIG. 6 is a perspective view showing the intended process flow and use for an embodiment of the coffee pod.

Looking at FIG. 3 it can be seen that the array of coffee pods is made into a single linear configuration (ribbon) wherein each compressed pod is connected to its two adjacent compressed pods (the one in front and the one behind) by a connection tab 18 with a means for separation 20 disposed thereon. (Alternate versions of this design utilize a tape format wherein there are multiple ribbon formats of the series of coffee pods that reside parallel to one another and are conjoined on their sides as disclosed further herein and illustrated in FIG. 4.) This ribbon format of presentation works best with the preferred embodiment linear conveyor belt pod advancing means and the first alternate embodiment vertical carousal pod advancing means. In the preferred embodiment coffee pod, the means for separation is a series of perforations formed through the approximate center of the connection tab 31 joining the coffee pods. (FIG. 6)

FIG. 4 shows a perspective view of a double linear array of coffee pods (tape format) showing its structural evolution throughout the coffee filling process. This is similar to the single linear array of FIG. 3 but instead of being in a ribbon format, (single linear array) it has at least another adjacent single linear array arranged in parallel so as to form a tape format (two or more parallel and conjoined linear arrays). This would allow for better stacking of the compressed pods 4 in the coffee pod point of sale fabrication device 2. The pods would thus be joined to other pods on three or four sides, depending on the width of the tape format (which is based on the number of conjoined single linear arrays in the tape.)

It is to be noted that similar to the ribbon format, in the tape format each compressed pod is separably connected to its three or four adjacent compressed pods (the one in front, the one behind, and the one on the left or right side, or the two on both the left and right sides) by a connection tab 18 with a means for separation 20 disposed thereon. Alternate embodiments of the means for separation, as discussed above, may be utilized and more than one embodiment of means for separation may be used on the conjoined pods in a tape format.

There is a plethora of other embodiments which the means for separation 20 could take. It could be a line of flexible mastic joining two short tabs that abut each other, it could be a releasable, flexible, adhesive strip spanning and affixed to two short tabs extending from each coffee pod top, it could be a frangible strip residing between two short tabs extending from the coffee pod top, or the like. In an other embodiment of the means to separate, the filter media used to form the fillable well could be made from a roll of filter media extended beyond the well to conjoin adjacent coffee pods 4, possibly forming the wells on adjacent coffee pods. The coffee pods would then lack a tab but rather, would be conjoined in a linear fashion by the length of filter media that formed all of the wells. There could be notches or perforation lines on any of the aforementioned means to allow separation in the way described that occurs at the curved end of the linear conveyor belt 50. The primary criteria for selection would be the resilience to minor twisting or expansive forces below a critical level without allowing the release of adjacent pods. These forces and the angles at which they are applied to the pods will differ depending on which embodiment of the coffee pod point of sale fabrication device the linear array of pods is being used with.

In a further alternate embodiment of coffee pod design, the coffee pods may not be attached to adjacent pods but rather fabricated as individual pods. This format of presentation works best with the second alternate embodiment fabrication device using the rotary platter pod advancing means (FIG. 15) where there are no forces for separation like those that occur at the curved end of the linear conveyor belt 82 (FIG. 8) as described herein.

In the way of a general overview, (FIG. 7) the coffee pod fabrication device 2 is fed a coffee pod 4 (either individually or from within an ordered array of coffee pods) from the pod loading means 46 (within the device's housing 48) onto the pod advancing means 50 where the coffee pod 4 has its well 10 expanded by a means for pod expanding 52. The pods are advanced below a coffee filling means comprised of a coffee bean hopper 54, a grinder 56, a doser 58 and a fill nozzle 60. This stores, grinds, measures and injects ground coffee beans into the expanded well 10. The filled coffee pod 62 continues advancement through an optional cleaning means 64 that removes any debris from the top face of the lid 12 of the pod so that the seal can be properly affixed. The filled pods 62 advances beneath the sealing means 66 which applies a seal to the lid 12 and then to an ejection station 68 that releases the sealed pods from the pod advancing means 50 and dispenses them through an exterior portal 70 in the housing 48 to the awaiting consumer. An optional bagging station 76 may collect the sealed pods 62 in a bag 74 prior to dispensing the sealed pods to the portal 70. An operation system having at least one processor and a tactile control panel 71 on the exterior of the housing provides customer input s well as signals for the initiation of the mechanized operation of the various components of the device 2. A optional debris collection station 78 may reside beneath the pod advancing means 50 where it inverts, to collect coffee grinds from the advancing means.

The mechanization of the features presented by the pod advancing means 50, means for pod expanding 52, coffee filling means, sealing means 66 and ejection station 68 (and optionally the cleaning means 64 and bagging station 76) are well known by one skilled in the art and involve rotary and or linear motors, compressors, and position and level sensors. They will not be described in detail herein. Their integrated operation is sequentially controlled by the operational system 72 which is in operative communication with these devices as is well known in the art.

This device 2 allows a user to fill a series of coffee pods 4 with their choice of a particular ground coffee bean or a blend thereof. These pods will be operationally compatible with most of the popular, commercially available, individual cup coffee brewing machines.

Looking at the broad conceptual drawing of FIG. 6 it can be seen that in its simplest configuration, the process flow for the point of sale coffee pod fabrication device 2 involves advancing a compressed coffee pod 4 out from its stored configuration in the pod loading means 46 (here a stacked array of separate individual pods 4), expanding the well 10, then shuttling the expanded pod 62 to a coffee filling means 80 to inject ground coffee into the well 10 and finally to a sealing means 66. Thereafter, ejection from the internal cavity of the housing via the ejection station may be as simple as gravitational free fall into a chute directed into the portal.

Figure 8:
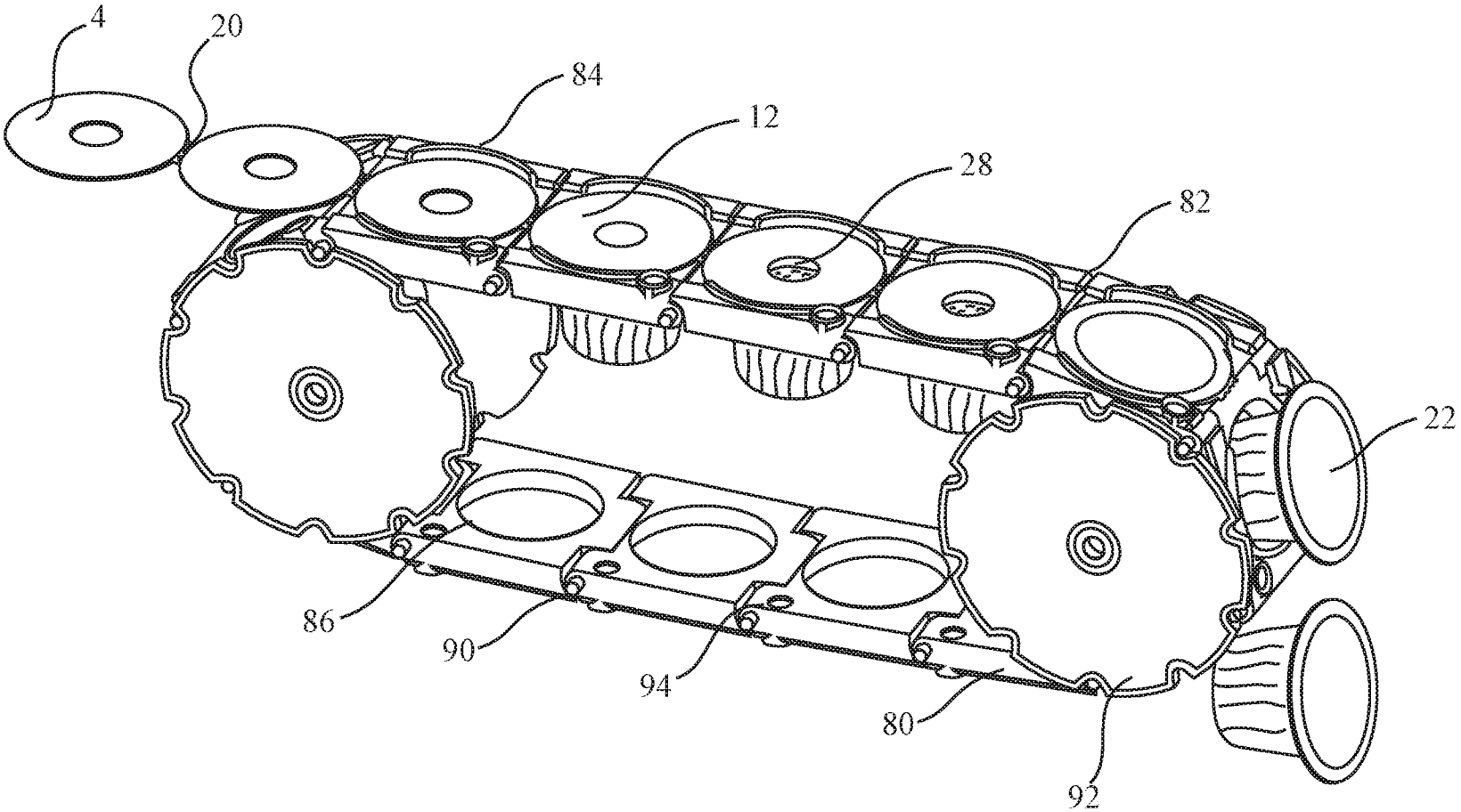
FIG. 8 is a front perspective view of the pod advancing means moving a linear series of coffee pods throughout the fabrication cycle.
Figure 9:
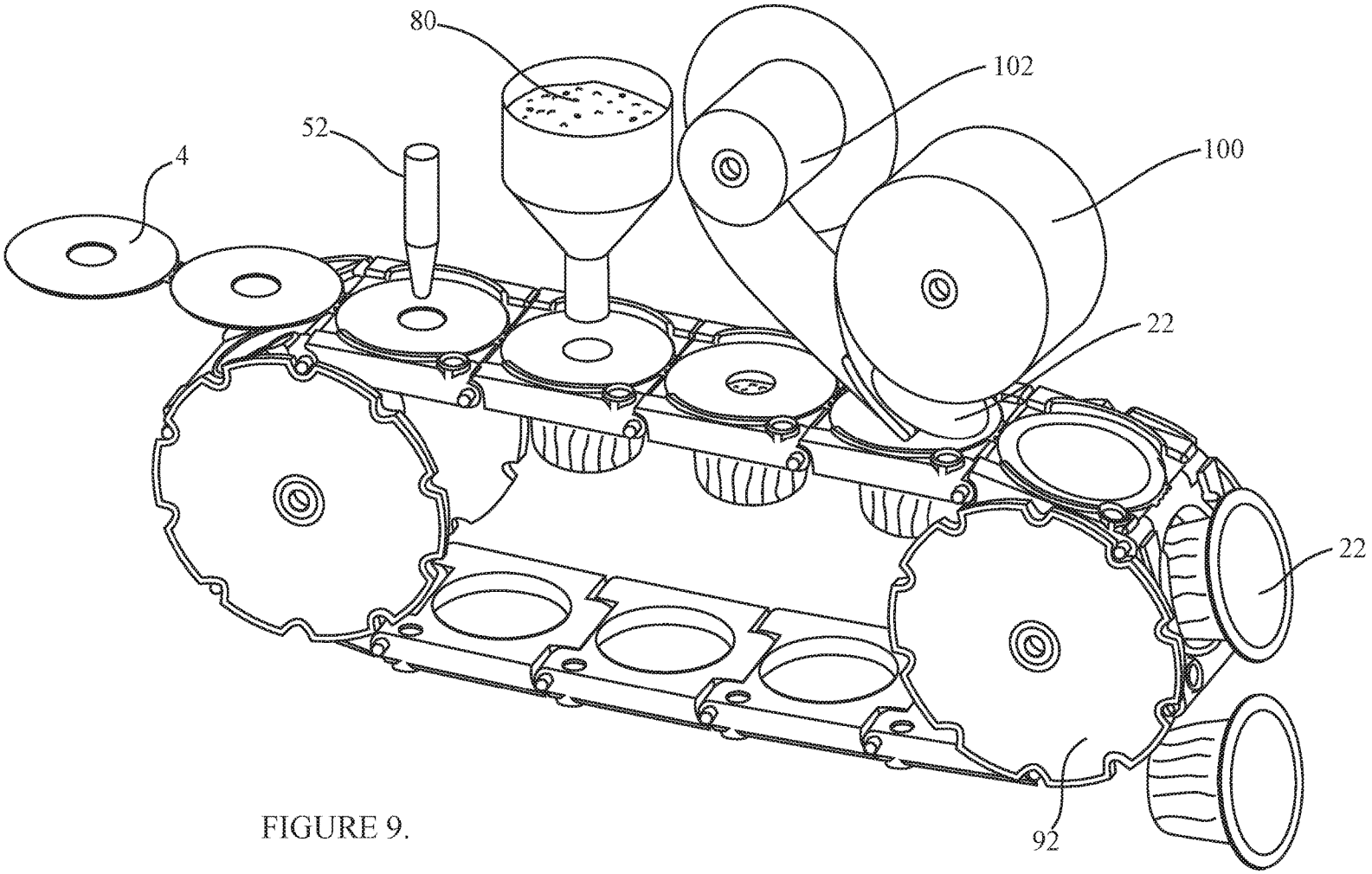
FIG. 9 is a front perspective view of a first embodiment coffee distributing machine using an embodiment of the coffee pod.
Figure 10:
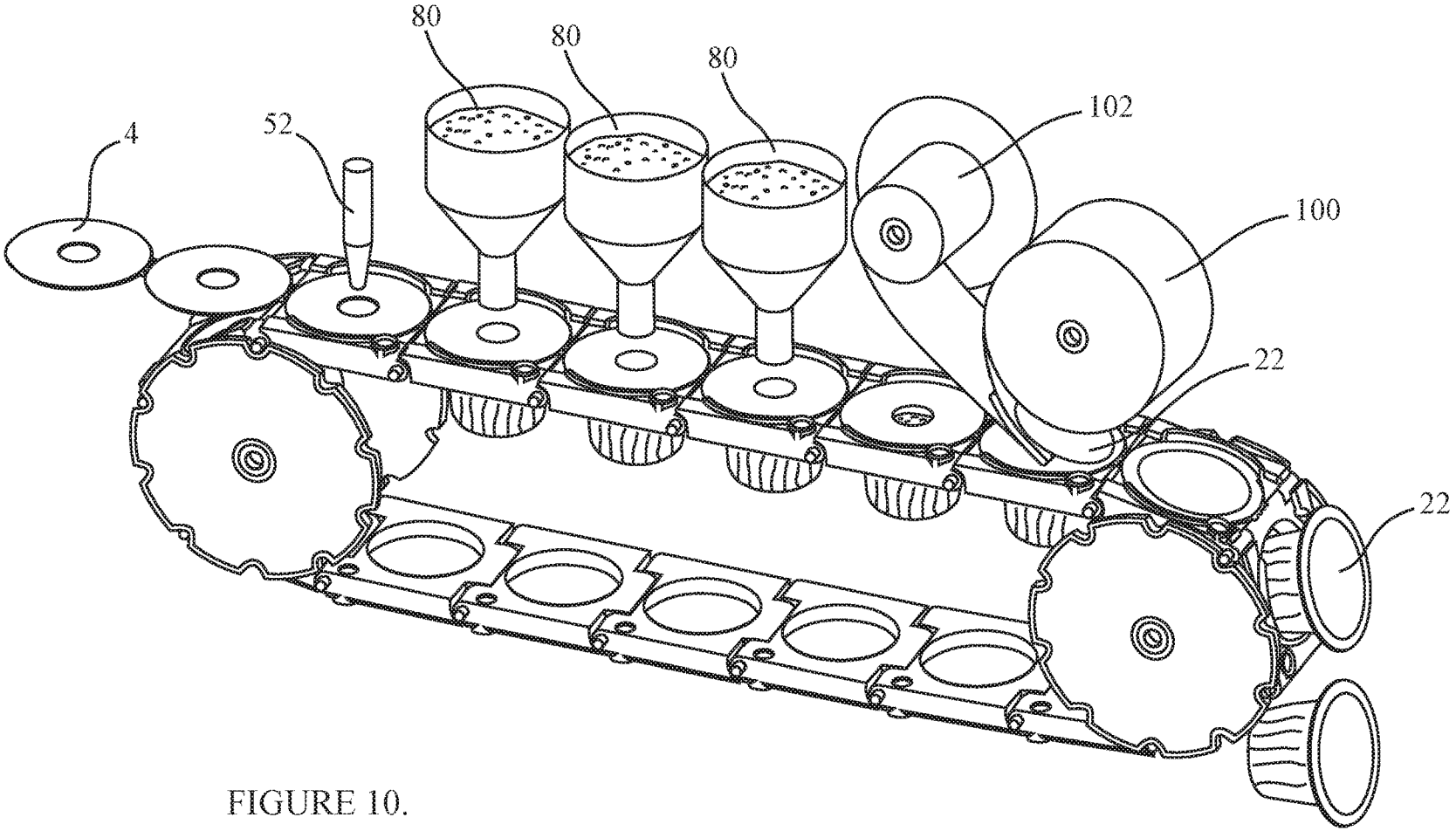
FIG. 10 is a front perspective view of a second embodiment coffee distributing machine using an embodiment of the coffee pod.

FIGS. 8-10 illustrate the pod advancing means 50 in its preferred embodiment, that of a looped linear conveyor belt 82 advancing the ribbon format preferred embodiment of coffee pods. The belt 82 is made of several substantially identical panels 88 pivotally connected by pins 90 such that the entire connected array is wound around two spinning wheels 92, that are toothed to engage panel orifices 94 so as to advance the belt 82 either or both of which may be driven. Here it can be seen that the compressed pods are located onto the conveyor belt 82 by alignment of their periphery against locating stop 84. This locates the lid 12 such that the well 10 of the pod lies directly atop the belt orifice 86 in one of the panels 88. When the well 10 is expanded to extend below the belt orifice 86 the advancement of the belt 82 pulls the successive linked pods from their pleat folded configuration in the pod loading means 46, so that the pod lids contact the locating stops 84 (which maintain the pod's position on the belt 82) and repeat the pod feed process. (Although pod location on the belt 82 is described as enabled by the locating stops 84 this positioning may be accomplished with a revolving toothed cog or gear that advances and locates the linear array of pods via a series of perforations (not illustrated) formed through the lid 12 of the pod, as is well known in the industry.

Figure 7:
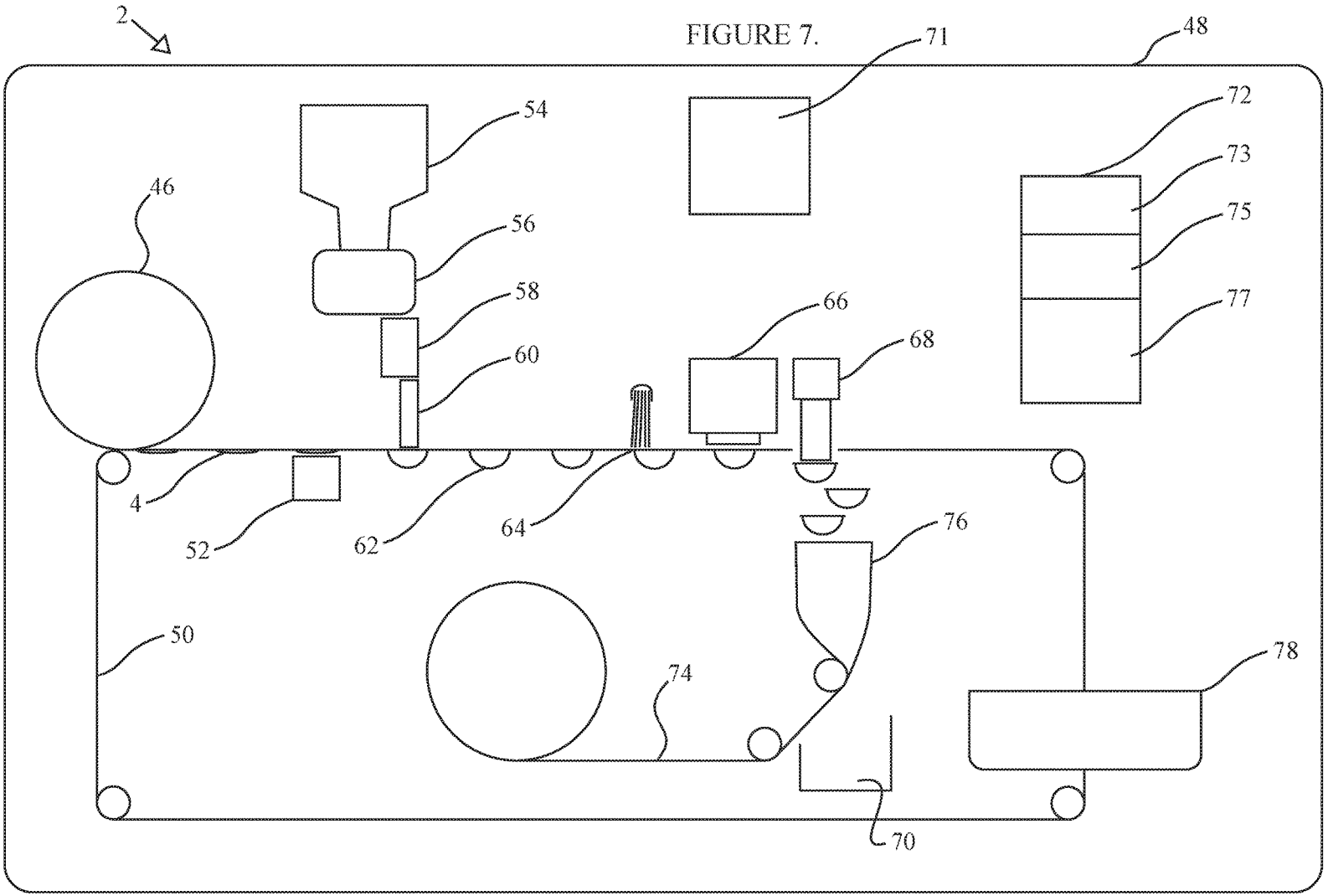
FIG. 7 is a diagrammatic representative illustration of an embodiment of the coffee pod point of sale fabrication device.

The expansion of the compressed coffee pod 4 into the expanded coffee pod is accomplished by an air expander that provides a burst of air past the upper lid orifice 28 and into the well 10 to inflateably expand the well into its concave configuration. In an alternate embodiment, a linear actuator connected to a mechanical rod may extend beyond the lid orifice 28 to contact the well 10 to mechanically urge or expand the well 10 to its full extent, or a vacuum may be applied to the underside of the compressed pod as shown in FIG. 7.

Looking at the manner of separation of the expanded, filled sealed coffee pods in the preferred embodiment, it can be seen that as the pods 4 reach the curved end of the track 82 the leading pod in the conjoined linear array drops from the planar path it traversed to be expanded, filled and sealed, and follows the oval path of the track 82. In doing so, two effects are put into motion. First, the tab 18 hinges about its approximate midpoint which is where the means for separation 20 resides. Second, the distance between the lids of the adjacent filled coffee pods increases. Each of these effects put stress on the means for separation 20 causing the perforations to tear and the adjacent pods to separate. With the belt inverting, the pods are ejected from the belt orifices 86 so that they may fall by gravity into a chute directed towards the portal or first to the optional bagging station 76.

Although the device 2 is described herein with the separation of the individual pods 4 from the ribbon array occurring at the ejection station 58 it is known that in other embodiments this separation could occur at the front end of the pod advancing means with the pods continuing along, their wells in the belt orifice 86 as they proceed through the expansion, filling, sealing and ejection.

FIGS. 9 and 10 show the preferred embodiment with the pod loading means 46 residing adjacent to the means for pod expanding 52 which resides adjacent to the coffee filling means 80 which resides adjacent to the sealing means 66 which resides adjacent to the ejection station 68. The sealing means 66 is shown as a advancing spool of adhesive seals 22 with a tape carrier take up reel n. FIG. 10 differs from FIG. 9 in that this embodiment uses several coffee filling means 80 to allow for more selective blending.

Figure 11:
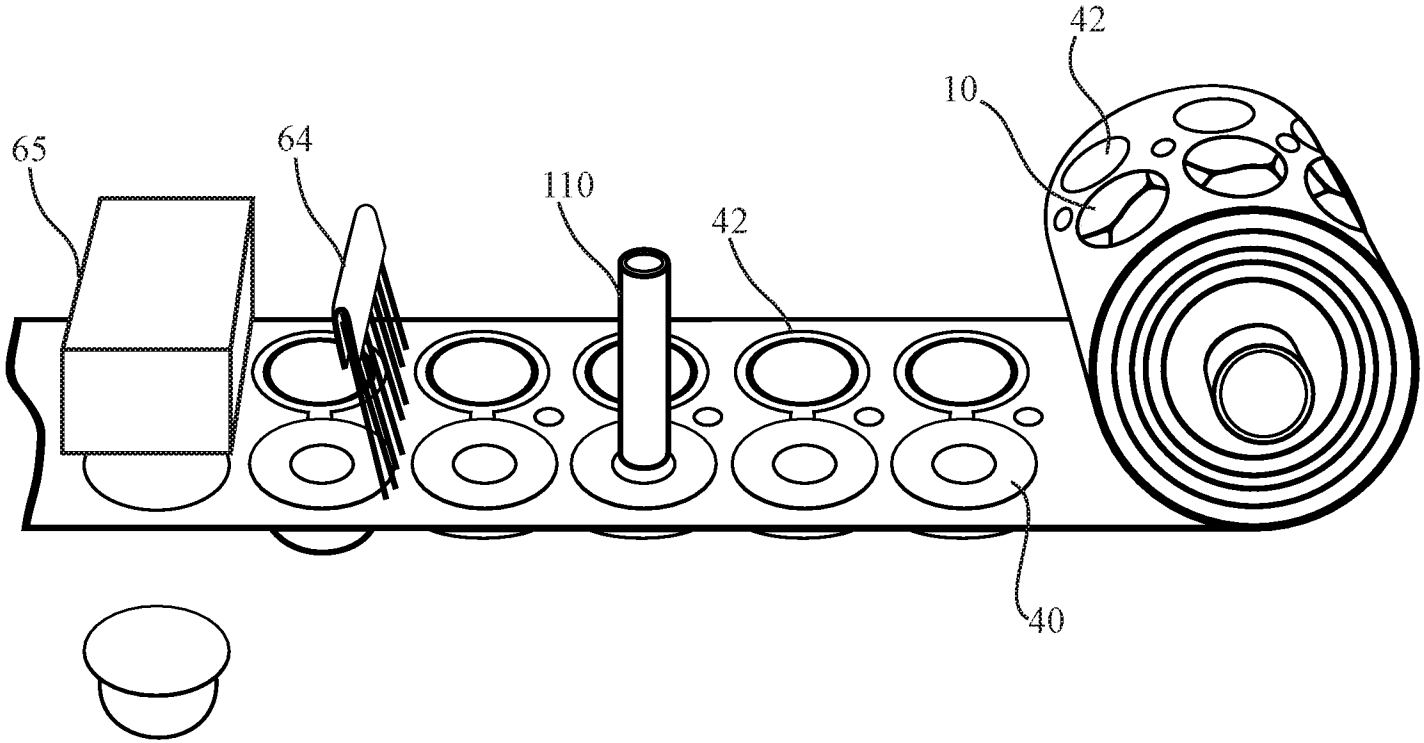
FIG. 11 is a front perspective representative view showing the cleaning station and a third embodiment of coffee pods as used with a second embodiment of pod advancing means belt.

FIG. 11 shows the third embodiment of coffee pod as it would be utilized in the device 2. Herein there is also an optional cleaning station 64 to ensure no debris hinders the sealing process. When utilized the cleaning station 64 would reside between the coffee filling means 80 and the sealing means 66. Although depicted as a brush, it may take the form of a host of other embodiments such is well known in the relevant art. It is to be noted that in this conceptual drawing there is no individual means for pod expansion and coffee filling means, rather they have been consolidated into a single expanding and filling device 110 that mechanically urges the well downward to expand it before it introduces the ground coffee through the same spout. A mechanical folding device 65 would seal the coffee filled pod by folding the first foldable half 40 onto the second foldable half 42 to seal the coffee filled pod and eject the pod.

Figure 15:
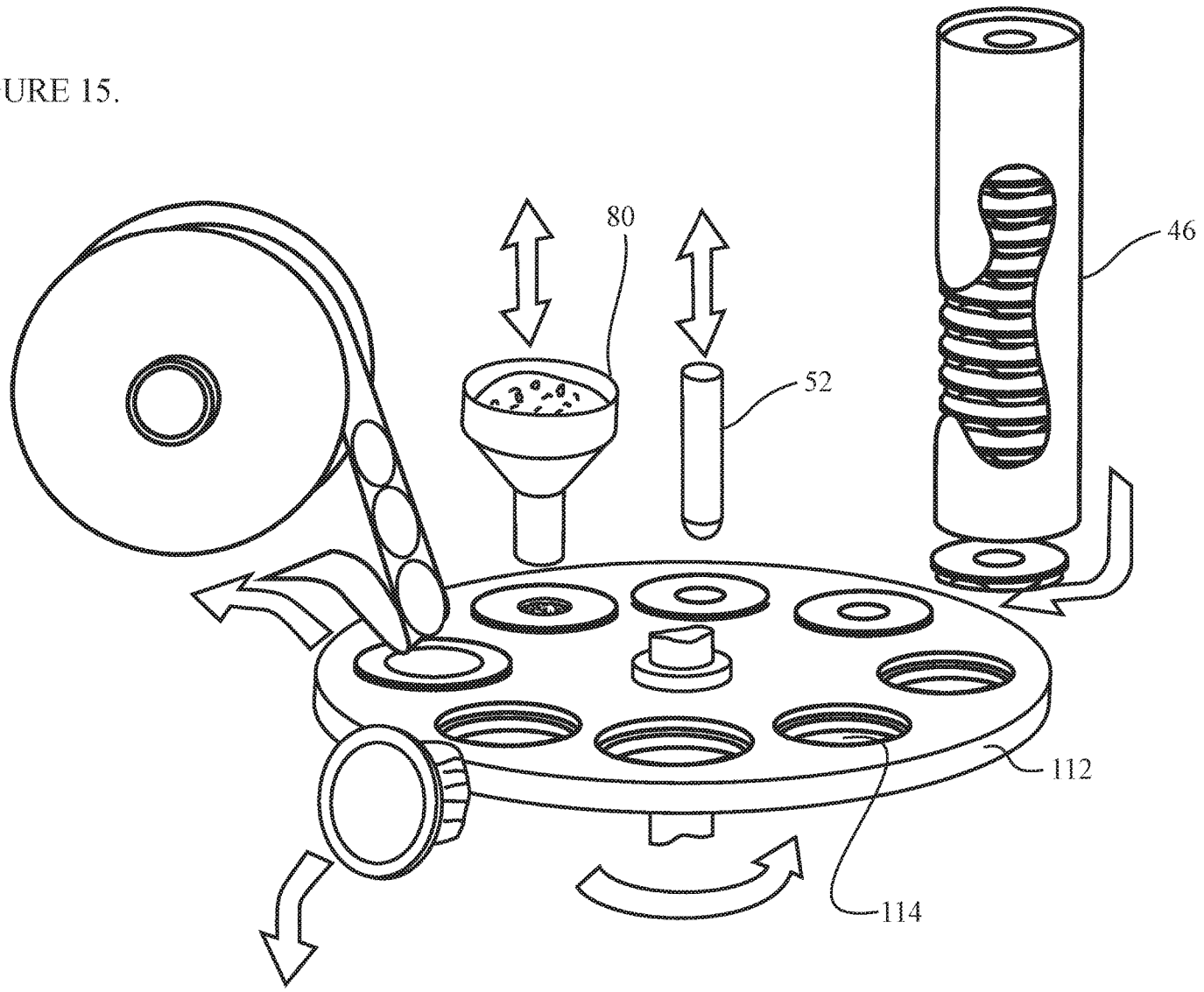
FIG. 15 is a perspective view of a second embodiment coffee pod point of sale fabrication device utilizing a rotary platter as the pod advancing means.

The preferred embodiment of the pod advancing means utilizes a conveyor belt that moves the array of pods along a linear path within the device 2. As can be seen in FIG. 15 the pod advancing means 50 may take the alternate configuration of a round rotatable platter 112 rather than a continuous feed moving belt. The overall operation of this embodiment varies from the preferred embodiment in that the pods 4 that are mechanically fed by the pod loading means 46 into the platter orifices 114 are separate rather than conjoined expandable pods. The remainder of the expanding, filling and sealing operations are substantially similar to that of the preferred embodiment. The ejection station however uses a mechanical rather than gravity method of ejecting the pods from the platter. Use of this embodiment requires modification to the preferred embodiment well within the ability of one skilled in the relevant art. It is to be noted that here the storage of the compressed coffee pods is done in a tube that is part of the pod loading means 46 while it is envisioned that the compressed pods 2 may be stored in a plethora of other configurations as would be well known in the industry.

Figure 16:
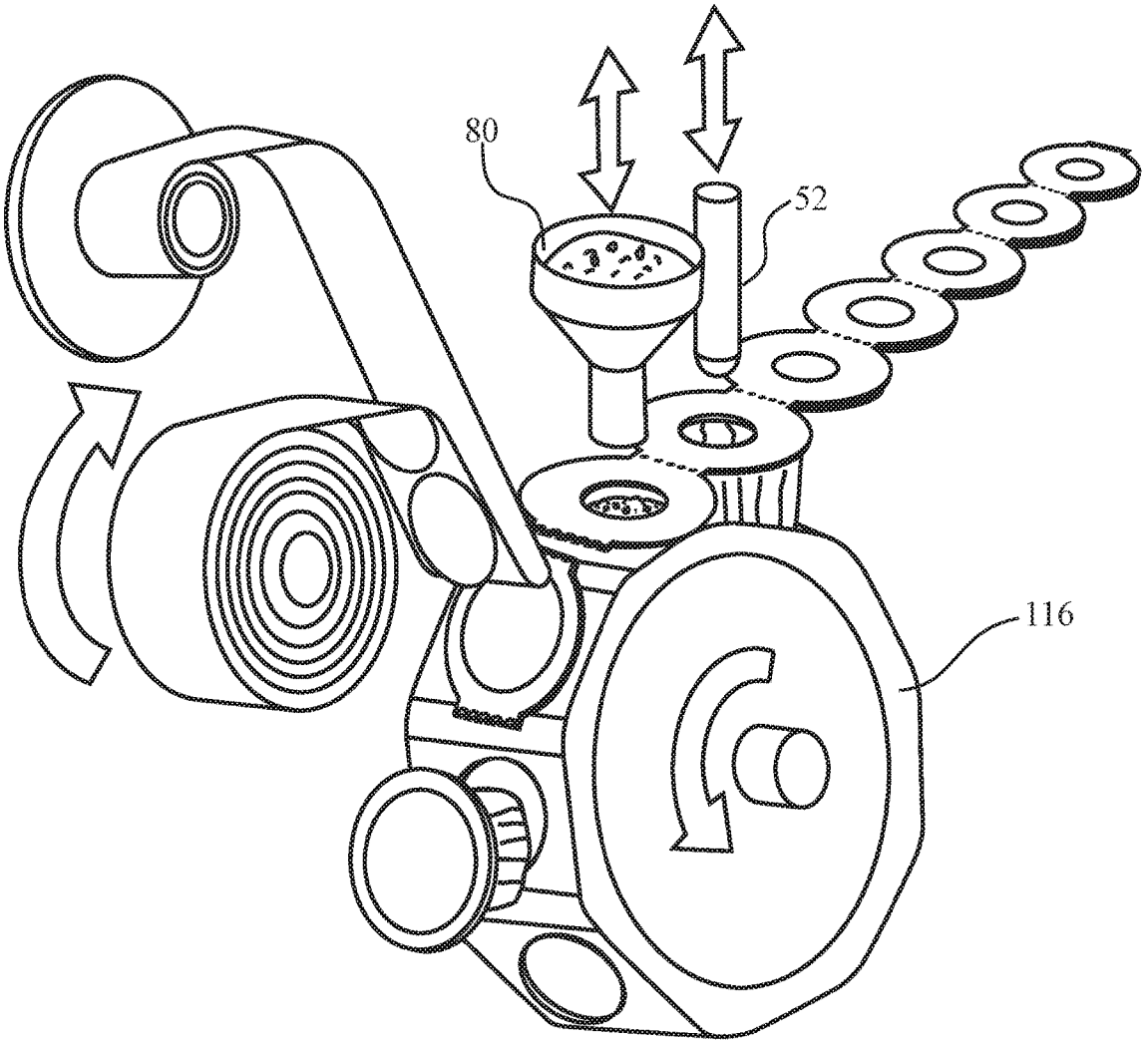
FIG. 16 is a perspective view of a third embodiment coffee pod point of sale fabrication device utilizing a vertical carousal as the pod advancing means.

FIG. 16 also depicts a different format for the pod advancing means, namely a vertically rotatable carousel 116. As can be seen, this embodiment still uses the ribbon format of conjoined pods and the ejection station functions in the same way as its counterpart in the preferred embodiment with the same method of separation of the expanded, filled sealed coffee pods as the preferred embodiment. The remainder of the inflating, filling and sealing steps remain unchanged.

FIG. 2 shows an alternate process flow for the point of sale coffee pod dispensing device 5 involving advancing a compressed coffee pod 2 stored in an coiled belt configuration 8, expanding the pod with air expander 7, filling the expanded pod 4 with freshly ground coffee from a grinding/dosing unit 10, cleaning the section of advancing belt from debris and coffee grinds with a surface cleaner 12, sealing the top of the filled, expanded pod 4 with a cap, ejecting the pod 4 from the belt with an ejector 14 into a vacuum pack bag 16 for dispensing to the customer.

FIGS. 9 and 10 show the general arrangement of the preferred embodiment at an operation level. They differ only in the number of means for coffee filling 80 that they use. With the embodiment of FIG. 10 it is possible to blend multiple coffee beans into each individual pod for an individualized flavor.

As can be seen the preferred embodiments of FIGS. 9 and 10, the advancement of the coffee pods from their compressed storage state to the dispensed, filled and sealed coffee pods is best mechanized utilizing a means for the connected movement of an array of individually separable coffee pods 28 (a ribbon format).

Figure 12:
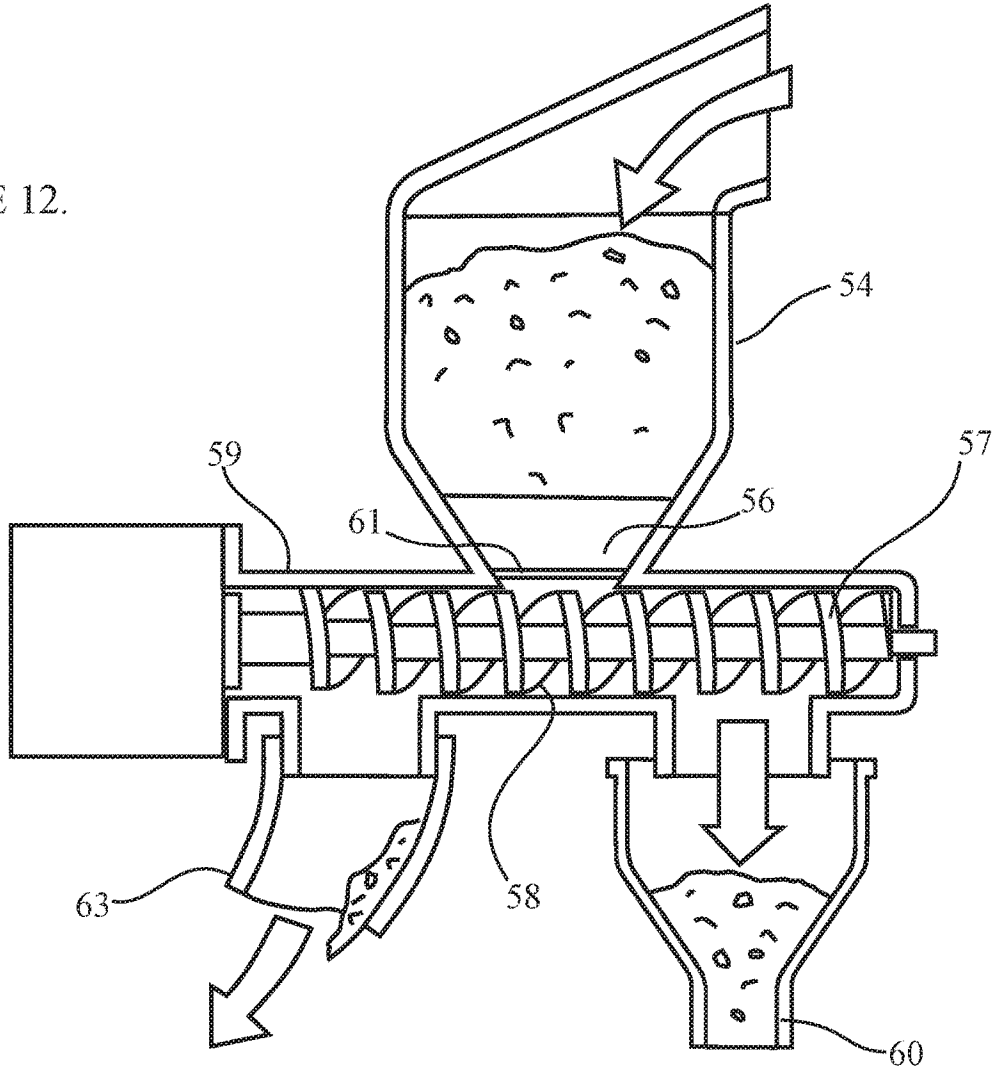
FIG. 12 is a side cross sectional view of an embodiment of the coffee filling means.
Figure 13:
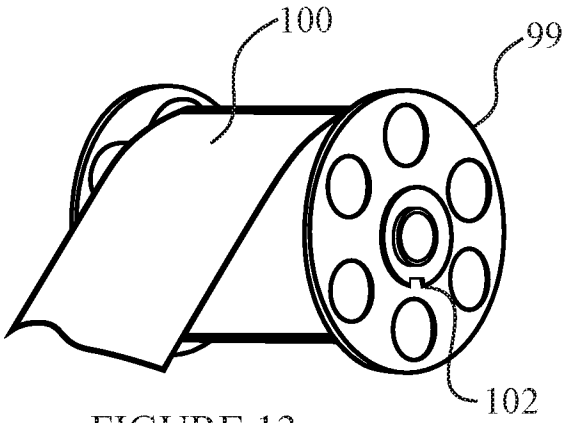
FIG. 13 is a side perspective view of an advancing spool.

With respect to some of the finer details of operation, in one embodiment the means for coffee filling 80 comprises a coffee bean hopper 54, a grinder 56, a doser 58 and a fill nozzle 60. (FIG. 12) When the signal for a dose of ground coffee beans is received, the motorized fill valve 61 is opened and the auger 57 in the doser 58 rotates so as to advance the ground coffee beans being fed by gravity from the grinder 56 (past the fill valve) down the auger tube 59 until it reaches the fill nozzle 60 and falls into the expanded pod well 10. There is a specific number of auger rotations keyed to the pod advancing means 50 that is representative of the volume of coffee beans required to adequately fill the well 10. After that point the auger will stop. Once the next pod 4 is in place under the fill nozzle 60, the fill valve will open again and the auger 57 will again rotate and repeat the fill cycle. After all of the selected number of coffee pods 4 have been filed and the fill valve has been closed, the auger 57 will run backwards to empty the auger tube of its coffee grinds into the waste chute 63 and into a catch container (not illustrated).

The feeding of adhesive seal 22 is driven by motors. Since the number of revolutions of the advancing spool 99 changes with the diameter of the seal roll 100 a magnetic pickup 102 and sensor arrangement, as is well known in the art, is keyed to the spool. This provides electronic feedback to the processor that algorithmically drives the spool so that the seals always matingly conform to properly seal the coffee pod upper lid 12.

The operational system 72 generates the specific operational signals based on user defined instructions and consumer input into the tactile input module 71. It is composed of a tactile input module 71, a billing module 73, a collection module 75 and an operational module 77. Generally, the device employs a processor or any device or combination of devices, that can operate to execute instructions to perform functions as described herein. Merely by way of example, and without limitation, any microprocessor can be used as a processor, including without limitation one or more complex instruction set computing (CISC) microprocessors, such as the single core and multicore processors available from Intel Corporation™ and others, such as Intel's X86 platform, including, e.g., the Pentium™, Core™ and Xeon™ lines of processors. Additionally and/or alternatively, reduced instruction set computing (RISC) microprocessors, such as the IBM Power™ line of processors, processors employing chip designs by ARM Holdings™ and others can be used in many embodiments. In further embodiments, a processor might be a microcontroller, embedded processor, embedded system, system on a chip (SoC) or the like.

There are two embodiments of the method of manufacturing coffee pods. The first is by an attendant and the second is by the consumer.

The first, preferred embodiment of the method of fabrication coffee pods is performed by an attendant at a distributor of coffee beans. The attendant would oversee the fabrication stream (all the steps listed), controlling both the quantity of the pods produced and the blend of coffee beans used as well as replenish the inventory of consumables used by the device (such as the pods, labels, coffee, bags etc.) and remove the accumulated trash (such as paper carrier for seals, coffee grinds etc.). The method would be performed on a coffee pod fabricating device (the device) with a single coffee filling means. It has the following steps:

Determining of the desired coffee beans (blended or otherwise) and the number of coffee pods desired to be fabricated;

Filling the hopper of the coffee filling means of the device with the desired coffee beans;

Driving the pods advancing means so as to draw the compressed coffee pod linear array from the pod feed station into their operational location on the pod advancing means belt (situating the top flange of the coffee pod to the location stops such that the filter well resides over the orifice in the belt);

Advancing the pod linear array to the pod well expansion means;

Expanding the filter well of the first pod in the linear array (until it extends below the orifice in the belt where the pod was indexed, to receive a volume of ground coffee);

Advancing the expanded pod until it resides operationally adjacent the coffee filling means;

Grinding the coffee beans in the hopper;

Delivering a quantity of ground coffee beans into the pod well;

Advancing the filled coffee pod through a cleaning station removing any debris from the top planar face of the pod (preparing it for sealing)

Advancing the filled pod to a sealing station;

Adhesively a seal onto the top planar face of the pod's lid, covering the filled well;

Advancing the sealed coffee to an ejection station;

Detaching the sealed pod from its adjacent pods;

Ejecting the sealed pod from the pod advancing means.

With the ribbon or tape style of conjoined pods, the trailing adjacent pods would also follow this same process so as to constitute a continual disbursement of pods. The selected number of pods will fall into a chute for disbursement to the consumer. A counting station monitors the number of pods generated and stops the device when the appropriate number is reached. The belt of the pod advancing means would continue advancing, empty, until it reached the pod feed station and another compressed coffee pod was seated into its indexed position.

There are additional steps to be performed prior to the fabrication of coffee pods by the device. These steps are:

Installing an adequate supply of coffee pods and seals in the device; and

Correctly locating the linear array of coffee pods onto the pod advancing means. (It is to be noted that correctly locating the linear array of coffee pods onto the conveyor belt using the preferred embodiment of the device is accomplished by alignment of the coffee pod's top flange periphery against the locating stop. This locates the filter wells of the pod directly atop the belt orifices in one of the panels and allows the pod array to be fed/dragged forward with the belt by the locating stop.)

The second, (alternate) embodiment of the method of manufacturing coffee pods is performed by the consumer using the device installed at a local store. The consumer would merely select both the quantity of the pods produced and the blend of coffee beans used. The method may be performed on a coffee pod fabricating device (the device) with a single coffee filling means however it is likely that the consumer operated version of the device would incorporate multiple coffee filling means. It has the following steps:

Determining the desired coffee beans (blended or otherwise) and the number of coffee pods desired to be fabricated and inputting this number into the tactile control panel;

Paying the cost presented in the video display interface of the tactile control panel;

Filling the hopper of the coffee filling means of the device with the desired coffee beans or optionally selecting the beans provided in the multiple hoppers of the coffee filling means;

Driving the pods advancing means so as to draw the compressed coffee pod linear array from the pod feed station into their operational location on the pod advancing means belt (situating the top flange of the coffee pod to the location stops such that the filter well resides over the orifice in the belt);

Advancing the pod linear array to the pod well expansion means;

Expanding the filter well of the first pod in the linear array (until it extends below the orifice in the belt where the pod was indexed, to receive a volume of ground coffee);

Advancing the expanded pod until it resides operationally adjacent the coffee filling means;

Grinding the coffee beans in the hopper;

Delivering a quantity of ground coffee beans into the pod well;

Advancing the filled coffee pod through a cleaning station removing any debris from the top planar face of the pod (preparing it for sealing)

Advancing the filled pod to a sealing station;

Adhesively placing a seal onto the top planar face of the pod's lid, covering the filled well;

Advancing the sealed coffee to an ejection station;

Detaching the sealed pod from its adjacent pods;

Ejecting the sealed pod from the pod advancing means.

Operationally, the consumer would initiate the operation of the fabrication stream by engaging the device's computerized control panel and using a tactile input module to select the quantity of pods, (by number of pods of weight/volume of coffee beans to be dispensed) the hopper or hoppers to be used for filling the pods. Some hoppers are filled with different selections of coffee beans and optionally, some hoppers may be vacant. If the consumer wants pods filled with their own coffee bean, and there is such an optional empty hopper, they would add their bean to the empty hopper. The billing module would calculate the cost and indicate this to the consumer on a video display interface. The consumer would pay the indicated cost electronically or with physical money to the appropriate collection module on the control panel, which upon verification of receipt of the full cost billed, would initiate the operational module to begin the pod filling process. This follows the same operational procedure as outlined above with the exception of the selective operation of one of the multiple coffee filling means. Optionally, there may be a delivery station used to collect all the filled, sealed pods in that consumer's order into one sealable container prior to delivery to the consumer. This may be done either automated or manually. The belt would continue advancing, empty, until it reached the pod feed station and another compressed coffee pod was seated into its indexed position.

As can be seen from the above disclosure, a linear series of successively linked compressible, shell less coffee pods having a means for separating coffee pods located on its hingeable connection tabs, allows for a method of rapid commercial filling of individual coffee pods. In its simplest methodology the coffee pod filling device would fill compressible coffee pods with the following steps:

A method of fabricating coffee pods from a coffee pod fabricating device comprising the following steps:

advancing a compressed coffee pod linear array into a fabrication stream;

sequentially expanding a coffee pod filter well of at least one coffee pod in the coffee pod linear array;

grinding a volume of coffee beans;

sequentially delivering ground coffee beans into at least one expanded coffee pod filter well;

sequentially sealing the filter well of least one coffee pod;

sequentially detaching the coffee pod from adjacent pods in the coffee pod linear array; and sequentially ejecting the coffee pod from the fabrication stream.

Optionally there would be a step removing any debris from the top planar face of the lid of the pod prior to sealing the filter well.

The steps described according to a particular methodology may be organized in alternative orders. Hence, while various embodiments are described with—or without—certain steps for ease of description and to illustrate exemplary aspects of those methods, the various steps described herein with respect to a particular method can be substituted, added, and/or subtracted from among other described steps unless the context dictates otherwise.

Consequently, although several exemplary method embodiments are described above, it will be appreciated that the methodology is intended to cover all modifications and equivalents within the scope of the following claims.

Having thus described the invention, what is claimed as new and desired to be secured by Letters Patent is as follows:

1. A method of fabricating coffee pods from a coffee pod fabricating device comprising the following steps:

moving a pod advancing means of said coffee pod fabrication device so as to draw a compressed coffee pod linear array onto a pod advancing means;

advancing said pod linear array to a pod well expansion means;

expanding a well of said pod in the coffee pod linear array by providing a burst of air into said well to inflateably said well into a concave configuration;

advancing said pod with expanded well until it resides operationally adjacent a coffee filling means;

grinding a volume of coffee beans in said coffee filling means;

delivering said ground coffee beans into said pod well;

advancing said coffee pod through a cleaning station removing any debris from a top planar face of a lid of said pod;

cleaning said top planar face free of debris in preparing for sealing said lid;

advancing said pod to a sealing station;

adhesively sealing said lid, covering said well;

advancing said pod to an ejection station;

detaching said pod from adjacent pods in said coffee pod linear array;

ejecting said pod from the pod advancing means.

2. The method of fabricating coffee pods of claim 1 comprising an additional first step of filling a hopper of the coffee filling means of said coffee pod fabrication device with coffee beans.

3. The method of fabricating coffee pods of claim 1 further comprising;

a step of initiating operation of the fabrication stream by selecting the quantity of pods to be fabricated;

a step of monitoring the number of pods generated and stopping said device when the appropriate number is reached.

4. A method of fabricating coffee pods from a coffee pod fabricating device comprising the following steps:

moving a pod advancing means of said coffee pod fabrication device so as to draw a compressed coffee pod linear array into an operational location on said pod advancing means;

advancing said pod linear array to a pod well expansion means;

expanding a filter well of said pod in the coffee pod linear array in preparation to receive a volume of ground coffee;

advancing said pod with expanded well until it resides operationally adjacent a first coffee filling means;

grinding a volume of coffee beans in said first coffee filling means;

delivering said volume of ground coffee beans into said pod filter well;

advancing said coffee pod through a cleaning station removing any debris from a top planar face of a lid of said pod;

cleaning said top planar face free of debris in preparing for sealing said lid;

advancing said pod to a sealing station;

adhesively sealing said lid, covering said well;

advancing said pod to an ejection station;

detaching said pod from adjacent pods in said coffee pod linear array;

ejecting said pod from the pod advancing means.

5. The method of fabricating coffee pods of claim 4 comprising the additional first step of filling at least one hopper of the coffee filling means of said coffee pod fabrication device with coffee beans.

6. The method of fabricating coffee pods of claim 4 further comprising the additional steps of;

a first step of initiating operation by selecting the quantity of pods to be fabricated;

a second step of accepting payment of a cost for the fabrication of the input number of coffee pods to be fabricated as presented by said coffee pod fabricating device; and a last step of monitoring the number of pods generated and stopping said device when the appropriate number is reached.

7. A method of fabricating coffee pods from a coffee pod fabricating device comprising the following steps:

advancing a compressed coffee pod linear array into a fabrication stream;

sequentially expanding a coffee pod filter well of at least one coffee pod in the coffee pod linear array with a linear actuator;

grinding a volume of coffee beans;

sequentially delivering said ground coffee beans into at least one expanded coffee pod filter well;

sequentially sealing said filter well of least one coffee pod;

sequentially detaching said coffee pod from adjacent pods in said coffee pod linear array; and sequentially ejecting said coffee pod from said fabrication stream.

8. The method of fabricating coffee pods from a coffee pod fabricating device of claim 7 further comprising the step:

removing any debris from a top planar face of a lid of said pod prior to sealing said filter well.

* * * * *